US005089236A

United States Patent [19]

Clerc

[11] Patent Number: 5,089,236

[45] Date of Patent: Feb. 18, 1992

[54] VARIABLE GEOMETRY CATALYTIC CONVERTER

[75] Inventor: James C. Clerc, Columbus, Ind.

[73] Assignee: Cummmins Engine Company, Inc., Columbus, Ind.

[21] Appl. No.: 467,165

[22] Filed: Jan. 19, 1990

[51] Int. Cl.[5] ..... F01N 3/10; F01N 3/24

[52] U.S. Cl. ..... 422/177; 422/168; 422/170; 422/171; 422/176; 60/286; 60/288; 60/287

[58] Field of Search ..... 422/168, 170, 171, 176, 422/177; 60/286-288

[56] References Cited

U.S. PATENT DOCUMENTS

| | | | |
|---|---|---|---|
| 1,940,700 | 12/1933 | Riehm | 422/177 |
| 2,991,160 | 7/1961 | Claussen | 60/288 |
| 3,083,084 | 3/1963 | Raymond | 60/288 |
| 3,180,712 | 12/1963 | Hamblin | 60/288 |
| 3,297,400 | 1/1967 | Eastwood | 60/288 |
| 3,544,264 | 12/1970 | Hardison | 60/299 |
| 3,674,441 | 7/1972 | Cole | 422/177 |
| 3,813,226 | 5/1974 | Heitland et al. | 60/299 |
| 3,954,418 | 5/1976 | Stormont | 60/299 |
| 3,972,685 | 8/1976 | Hanaoka | 60/299 |
| 4,196,170 | 4/1980 | Cemenska | 422/171 |
| 4,425,304 | 1/1984 | Kawata et al. | 422/171 |
| 4,510,749 | 4/1985 | Taguchi et al. | 60/286 |
| 4,597,262 | 7/1986 | Retallick | 60/274 |
| 4,625,511 | 12/1986 | Scheitlin et al. | 60/299 |
| 4,961,314 | 10/1990 | Howe et al. | 60/288 |

FOREIGN PATENT DOCUMENTS

| | | | |
|---|---|---|---|
| 0065812 | 4/1982 | Japan | 60/288 |

*Primary Examiner*—Robert J. Warden

*Attorney, Agent, or Firm*—Sixbey, Friedman, Leedom & Ferguson

[57] ABSTRACT

A system is provided for reducing detectable hydrocarbons in the exhaust gas of a diesel engine and for retarding the formation of sulfate including a housing having an inlet and an outlet, a first exhaust gas glow passage extending from the inlet to the outlet within the housing, a first catalyst bed positioned within the first flow passage, a second exhaust gas flow passage extending from the inlet to the outlet within the housing, and a second catalyst bed positioned within the second flow passage. Also provided is a valve for directing the flow of the exhaust gas through one of the first and second flow passages, and an electronic control for controlling the valve in response to engine load and exhaust gas temperature such that the exhaust gas is directed through the first flow passage and the first catalyst bed under low engine load and low exhaust gas temperature conditions and through the second flow passage and the second catalyst bed under high engine load and high exhaust gas temperature conditions.

19 Claims, 1 Drawing Sheet

VARIABLE GEOMETRY CATALYTIC CONVERTER

TECHNICAL FIELD

This invention relates to an apparatus for reducing the particulates emitted from compression ignition or internal combustion engines. More particularly, this invention relates to a system which provides both a large volume precious metal catalyst bed and a small volume precious metal catalyst bed and a high temperature valve for directing the exhaust gas flow through either of the catalyst beds depending upon engine load conditions.

BACKGROUND OF THE INVENTION

By the year 1991, the particulate emission standards set by the Environmental Protection Agency (EPA) will require all urban buses to emit less than 0.1 gm/hp-hr of particulate matter. The same standard will apply to heavy duty trucks in 1994. Particulates are defined by the EPA as any matter in the exhaust of an internal combustion engine, other than condensed water, which is capable of being collected by a standard filter after dilution with ambient air at a temperature of 125 degrees Fahrenheit. Included in this definition are agglomerated carbon particles, absorbed hydrocarbons, including known carcinogens, and sulfates.

These particulates are very small in size, with a mass median diameter in the range of 0.1-1.0 micrometers, and are extremely light weight. Particulate filter traps have been developed which are effective to remove a sufficient quantity of the particulates from the exhaust gas of a typical diesel engine for a truck or bus to bring the exhaust emissions into compliance with the EPA regulations. During normal operations of a typical vehicle engine, approximately 20 cubic feet of particulate matter must be trapped per 100,000 miles of vehicle operation. Obviously this particulate matter cannot be stored within the vehicle. Therefore successful long term operation of a particulate trap-based exhaust after-treatment system (EAS) requires some method for removal of the trapped particulates. One method which has proven to be successful has been to provide a particulate trap for trapping particulate matter, and periodically regenerating the trap to burn off the trapped particles. See for example Mogaka et.al., "Performance and Regeneration Characteristics of a Cellular Ceramic Diesel Particulate Trap," SAE Paper No. 82 0272, published Feb. 22-26, 1982. The regeneration process is typically initiated by a control system and is carried out by the delivery of heat to the inlet of the particulate trap at a temperature in excess of 1200 degrees Fahrenheit. The process results in oxidation of the filtered carbonaceous particulates in a manner that restores the trap's "clean" flow restriction but unavoidably produces temperature gradients and resultant thermal stresses in the particulate trap. The magnitude of these stresses must be controlled to a level that will not result in fatigue failure of the filter within its designed operating life. Due to the complexity and cost of this system, an alternative to particulate traps is needed to achieve up to a 40% reduction in One such alternative is the catalytic reactor or converter. Noxious elements in engine exhaust emissions may also be at least partially removed by passing the exhaust through a thermal catalytic converter. These converters typically contain a ceramic or metal catalyst support with a precious metal catalyst which will allow chemical oxidation reactions to occur and convert the exhaust gases to a more innocuous form whose presence in the atmosphere is less objectionable.

Catalytic converters are now standard equipment on gasoline powered automobiles, and their practicality for gasoline engines is well demonstrated. Catalytic converters for diesel engines pose different problems which have not yet been solved. Diesel exhaust is cooler than the exhaust from a gasoline engine, especially when the diesel engine is idling or running at low power output. Sometimes the diesel exhaust is so cool that a catalytic converter cannot ignite and burn the easily-combustible carbon monoxide and hydrocarbons in the exhaust. Even when the diesel engine is running at high power output, the exhaust is seldom hot enough to burn the carbonaceous particulates therein. The particulates would pass through the converter and add to the suspended solids in the atmosphere. Therefore, carbonaceous particulates must be controlled within the engine through fuel injection, air-handling, and combustion chamber improvements.

Presently, systems for purifying exhaust gas emanating from an engine include a housing having a chamber filled with catalytic material. The exhaust gas passes through perforated walls or screens into the filled chamber and is discharged therefrom into an exhaust pipe in a chemically modified and more acceptable form. For spark-ignition engines, emphasis has been directed to primarily reducing the oxides of nitrogen in the exhaust gases, while also diminishing the amounts of carbon monoxide and hydrocarbons. Unfortunately, during operation of the engine the amount of nitric oxide in the exhaust gases as well as other constituents vary with the load and other operating parameters of the engine. Also, the overall effectiveness of the catalytic converter varies with temperature changes of the catalytic material. To solve these problems, complex systems have been developed to controllably modify the purification of the exhaust as a function of the temperature of the catalytic material, the engine speed or the load by utilizing dampers, by-pass valves and the like. These complex systems are not only expensive, but the control valves must operate in the very hostile environment of the hot exhaust gas.

One attempt or solution to the aforementioned problem is to utilize different catalyst beds in series as is disclosed in U.S. Pat. No. 3,544,264 issued to Hardison. While the initial catalyst bed may be adjacent the engine exhaust manifold so that it can operate at a relatively high temperature, the next catalyst bed may be located a greater distance from the exhaust manifold where it can operate at a lower temperature. Additional clean air may also be supplied to the beds to promote the reaction. However, there is no consideration for varying engine loads nor is there any provision for shifting the exhaust flow. Consequently the exhaust gas must continuously flow through both converters.

In the U.S. Pat. No. 4,196,170 issued to Cemenska, a multi-stage catalytic converter is disclosed which includes a pressure responsive flow control valve which restricts the flow of exhaust gas through a first catalyst bed in response to a particular operating condition and which allows exhaust gas to flow through both the first catalyst bed and a second catalyst bed in response to a change in the operating condition of the engine. Further, pressurized ammonia is injected into the exhaust flow, so as to reduce nitric oxides in the gas. Preferably, the first catalyst bed is of a material which is effective at low temperatures with the second being of a material which is most effective at a higher temperature, and a third catalyst bed being of a material which is most effective at yet a higher temperature. However, with the arrangement disclosed by Cemenska, the first catalyst bed is continuously subjected to exhaust gas flow even at relatively high temperatures where it is essentially ineffective. By doing so, there is an inevitable likelihood that the first and even second catalyst beds may prematurely burn out because they are unnecessarily exposed to such extreme temperatures.

In an effort to maximize the efficiency of catalytic converters it has been proposed to provide two or more catalytic converters in parallel as is disclosed in U.S. Pat. No. 4,597,262 issued to Retallick and U.S. Pat. No. 4,625,511 issued to Scheitlin et.al. In the former, two catalytic converters of substantially the same construction are disposed in parallel and, during normal operation, exhaust gas is passed through both converters simultaneously. Once a predetermined condition is sensed in either of the converters, fuel is dispersed into the exhaust stream to that converter for regeneration purposes. In the latter, a housing structure is set forth for positioning catalytic converters of substantially equivalent filter efficiencies in series or in parallel wherein the converters are accommodated in a compact housing. However, with these structures, exhaust gas is continuously passed through both converters simultaneously in order to reduce the amount of particulate matter which is expelled into the atmosphere. Neither of the above mentioned disclosures provide for control of exhaust flow between two converters with variations in engine load and more importantly, variations in exhaust gas temperature. The higher the exhaust gas temperature, generally associated with high engine loads, the greater the likelihood of sulfate formations. With the above mentioned exhaust gas treatment systems, there is no distinction made between exhaust gas at low engine loads and that at high engine loads, consequently, the efficiency of such systems can not be maximized over a range of engine loads.

SUMMARY OF THE INVENTION

It is a primary object of the present invention to overcome the disadvantages associated with the above mentioned systems by providing an exhaust gas purification system which both economically and efficiently reduces the amount of hydrocarbons entrained in exhaust gas while retarding the formation of sulfate.

Another object of the present invention is to provide an exhaust gas purification system having the capability to effectively reduce the exhaust gas entrained hydrocarbons and retard sulfate formation at both low engine load and low exhaust gas temperatures, and high engine load and high exhaust gas temperatures. This is carried out in accordance with the present invention by providing a purification system wherein the geometry of the system may be readily varied in response to a predetermined sensed condition.

Still another object of the present invention is to maximize the reduction of hydrocarbons entrained in exhaust gas expelled from a diesel engine at a low temperature and during low engine load conditions by passing the exhaust gas through the catalyst bed of a sufficient volume catalytic converter evidencing low space velocities so that the exhaust gas emanating from the diesel engine during start-up or idle conditions is sufficiently purified.

Yet another object of the present invention is to minimize the formation of sulfate at high engine loads and high exhaust gas temperatures by passing the exhaust gas through the catalyst bed of a reduced volume catalytic converter evidencing high space velocities so that exhaust gas emanating from the diesel engine under these conditions is sufficiently purified.

Another object of the present invention is to provide a control mechanism for properly directing the exhaust gas flow dependent on the engine's operating conditions.

The above objects are achieved in accordance with a preferred embodiment of the present invention by providing a system for reducing detectable hydrocarbons in the exhaust gas of a diesel engine and for retarding the formation of sulfate including a housing having an inlet and an outlet, a first exhaust gas flow passage extending from the inlet to the outlet within the housing, a first catalyst bed positioned within the first flow passage, a second exhaust gas flow passage extending from the inlet to the outlet within the housing, and a second catalyst bed positioned within the second flow passage. Also provided is a valve for directing the flow of the exhaust gas through one of the first and second flow passages, and an electronic control system for controlling the valve in response to engine load and exhaust gas temperature such that the exhaust gas is directed through the first flow passage and the first catalyst bed under low engine load and low exhaust gas temperature conditions and through the second flow passage and the second catalyst bed under high engine load and high exhaust gas temperature conditions.

In order to adequately reduce hydrocarbon emissions at low temperature and low engine loads, the first catalyst bed is selected to have optimum composition and space velocities. That is the catalyst bed evidences a low ratio of the mass flow rate of the exhaust gas through the bed with respect to the size of the catalyst bed. Such is necessary to ensure that exhaust gas flowing therethrough at low temperatures remains in contact with the catalyst bed for a predetermined period of time to ensure adequate hydrocarbon conversion. With respect to high temperature exhaust gas, the formation of sulfur trioxide and ultimately the formation of sulfuric acid in the atmosphere is of greatest concern. Consequently, the catalyst bed for treating high temperature exhaust gas is chosen to have optimum composition and space velocities so that the exhaust gas is only minimally obstructed within the catalyst bed t minimize sulfate formation while recognizing a sufficient reduction in hydrocarbon emissions.

These as well as other objects and advantages of the present invention will become apparent from the figures as well as the following detailed description of the preferred embodiment.

DETAILED DESCRIPTION OF THE PREFERRED EMBODIMENT

Figure 2:
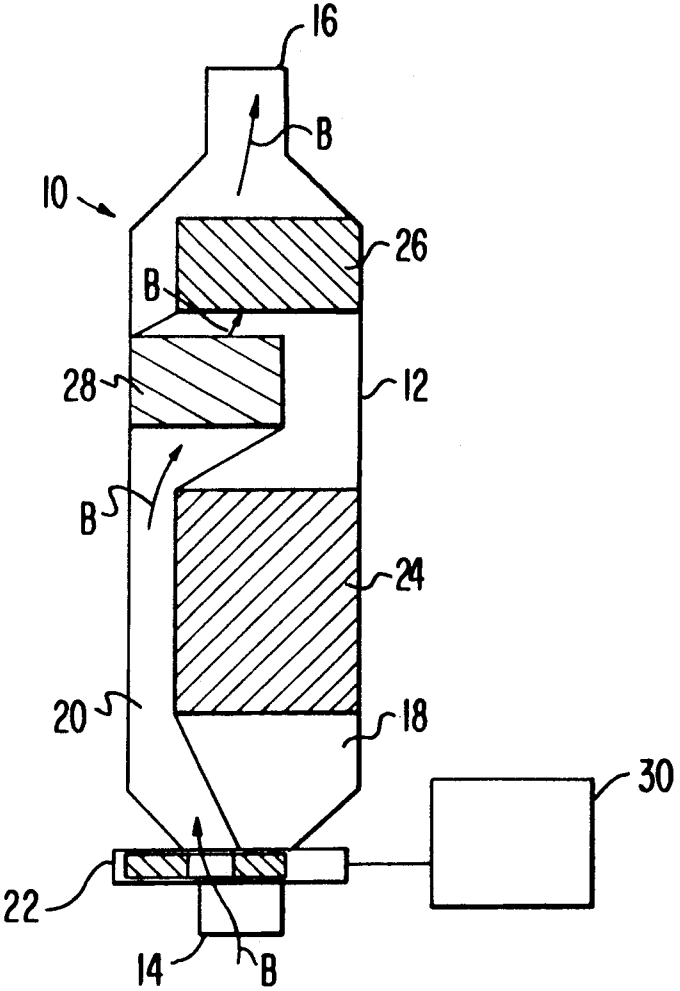
FIG. 2 is a schematic representation of the exhaust gas purification system shown in FIG. 1 wherein the exhaust gas is at a high temperature and the engine is operating under high engine loads.
Figure 1:
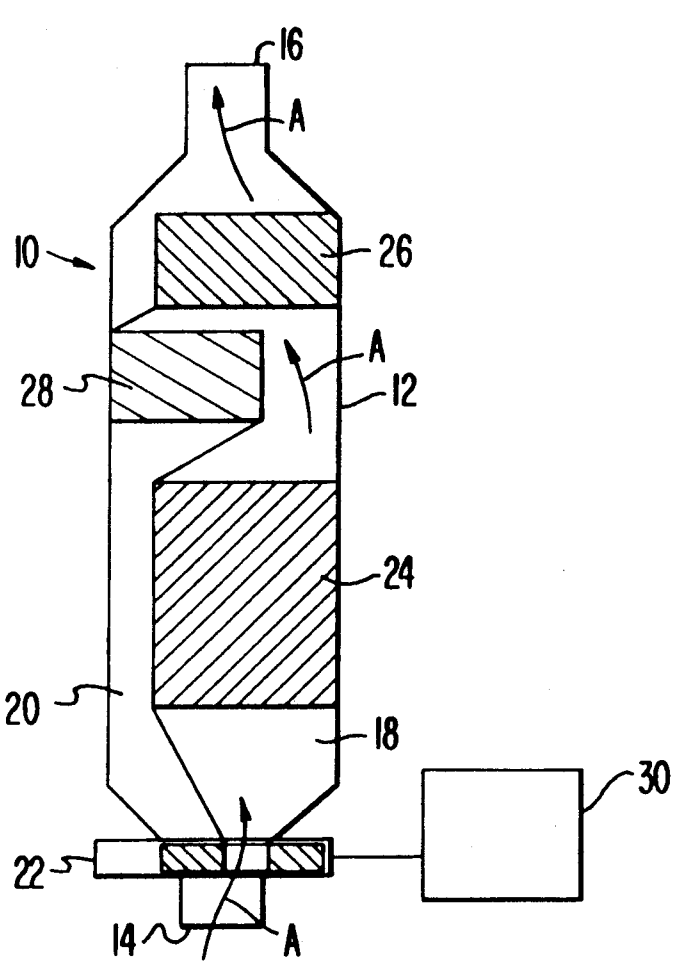
FIG. 1 is a schematic representation of the exhaust gas purification system in accordance with the preferred embodiment of the invention wherein the exhaust gas is at a low temperature and the engine is operating under low engine load.

FIGS. 1 and 2 each set forth a schematic representation of the exhaust gas purification system including a variable geometry catalytic converter 10 in accordance with the preferred embodiment of the invention. The variable geometry catalytic converter 10 consists of a housing 12 which includes an inlet 14 and an outlet 16 for allowing exhaust gas from a diesel engine to pass therethrough in a controlled manner. Within the housing 12 there is a first passageway 18 and a second passageway 20 which permits exhaust gas to be selectively passed therethrough in response to predetermined engine parameters. A high temperature valve 22 is positioned at the inlet 14 of the housing 12 so as to selectively direct the exhaust gas flow through either the first passage 18 or the second passage 20.

Positioned within the first passage 18 is a large volume precious metal catalyst which may be composed of platinum, paladium or rhodium. Platinum provides efficient hydrocarbon conversion at low temperatures and low engine loads; however, such a precious metal is expensive to employ. Paladium, while it is much less expensive to employ, does not provide as efficient hydrocarbon conversion at low temperatures. Therefore, the particular composition to be employed would be directly dependent on a balance of economic and efficiency factors. Positioned downstream of the large volume precious metal catalyst bed 24 is a muffler or similar sound attenuation device 26 for muffling sounds associated with combustion engines prior to the exit of the exhaust gas through the outlet 16.

Similarly, positioned within the second passage 20 is a small volume precious metal or non precious metal catalyst bed 28 which may be composed of a variety of metals. Again, platinum is particularly effective at minimizing hydrocarbon output, however, at high temperatures, approximately 800° F., platinum begins to evidence the production of sulfate which is undesirable. Paladium and rhodium are much better suited for high temperature catalyst beds. Additionally, compounds containing transition metals such as chromium, vanadium, lanthanum and cerium may be used at high temperatures. As can be seen from the figures, each of the first passage 18 and the second passage 20 intersect within the housing 12 such that only a single muffler 26 need be present within the housing. Consequently, exhaust gas passing through the second passage 20 will, as with exhaust gas passing through the first passage 18, be passed through the muffler 26 prior to its emission into the atmosphere through outlet 16.

As stated previously, the large volume catalyst bed 24 positioned within the first exhaust gas flow passage 18 is of a composition which is particularly effective at reducing hydrocarbons entrained within the exhaust gas at low temperatures and low engine loads. While the composition of the large volume catalyst bed 24 is chosen to optimize hydrocarbon conversion at low engine loads, the size of the large volume catalyst bed as well as the internal space velocities are similarly chosen so as to optimize hydrocarbon conversion at low engine loads. For hydrocarbon conversion at low temperatures and low engine loads it is desired to provide a large volume catalyst bed having low space velocities which is a non-dimensional parameter calculated by comparing the mass flow rate of the exhaust gas passing through the catalyst bed with the overall size of the catalyst bed. By providing a large volume catalyst bed having low space velocities, exhaust gas emitted from the diesel engine at low temperatures and low engine loads will be exposed to the catalyst bed composition for a greater period of time and consequently will result in the necessary amount of hydrocarbon conversion.

The small volume catalyst bed 28 positioned within the second exhaust gas passage 20 is as mentioned above a small volume catalyst bed which is particularly effective at minimizing sulfate formation at high engine loads. The small volume catalyst bed 28 in turn has high space velocities, i.e., capable of a high mass flow rate with respect to its size which allows exhaust gas passing through the second exhaust gas passage 20 to pass therethrough with sufficient residence time to minimize the formation of sulfate while adequately reducing hydrocarbon emissions. Because the exhaust gas output of diesel engines varies with engine size as well as the environment in which the engine is to operate, the size and composition of each of the large volume catalyst bed 24 and the small volume catalyst bed 28 would be selected to provide the best hydrocarbon conversion/-sulfate formation trade-off for that particular bed.

As previously mentioned, positioned at the inlet 14 of the housing 12 is the high temperature valve 22. This high temperature valve 22 operates to direct the exhaust gas flow through either the first exhaust gas passage 18 or the second exhaust gas passage 20. An electronic control system 30 is provided to control the high temperature valve 22 in order to selectively direct the flow of exhaust gas through either the large volume catalyst bed 24 or the small volume catalyst bed 28. It is the electronic control system 30 which senses various engine control parameters and positions the high temperature valve 22 in either the position shown in FIG. 1 wherein the exhaust gas is at a temperature less than 500° F. with the engine operating under low load conditions, and the position illustrated in FIG. 2 wherein the exhaust gas is at a temperature greater than 500° F. with the engine operating under high loads. The exhaust temperature used as a switchpoint for the high temperature valve would be influenced by engine and catalyst characteristics. The parameters for which the electronic control system 30 will monitor would be engine load which may be sensed in any conventional manner such as from the engine speed, rack position, fuel rail, or intake manifold pressure and the temperature of the exhaust gas being emitted by the diesel engine. Given this information, the electronic control system would move the high temperature valve 22 to the position shown in either FIG. 1 or FIG. 2 depending upon the value of such parameters.

The operation of the variable geometry catalytic converter will now be described in greater detail. Initially, the high temperature valve 22 is set in the position shown in FIG. 1 wherein the exhaust gas is directed as shown by arrows A through the first exhaust passage when the engine is operating under low loads and the exhaust gas temperature is less than 500° F. These conditions exist primarily during start-up of the diesel engine, during light load operation, and when the engine idles for a prolonged period of time such as at a truck stop or a loading dock. Once the exhaust gas temperature has reached approximately 500° F. and the engine is operating at high engine loads the electronic control system 30 will sense such conditions and move the high temperature valve 22 to the position shown in FIG. 2 wherein the exhaust gas is directed through the second flow passage 20 as shown by arrows B. The high temperature valve 22 remains in the position shown in FIG. 2 until such time as the electronic control system 30 senses low exhaust gas temperatures and low engine load so as to move the high temperature valve to the position shown in FIG. 1. In either case, the exhaust gas after flowing through the respective catalyst bed is directed through the muffler 26 prior to its emission into the atmosphere through outlet 16. As mentioned previously, the catalyst bed size and the composition of the catalyst bed are each chosen to optimize the hydrocarbon conversion/sulfate formation trade-off for the particular bed under the particular operating characteristics. However, it is essential that the size and composition of the catalyst bed be chosen so as to achieve good hydrocarbon conversion at low exhaust temperatures and avoid excessive sulfate formation at high exhaust temperatures.

While the invention has been described with reference to a preferred embodiment, it will be appreciated by those skilled in the art that the invention may be practices otherwise than as specifically described herein without departing from the spirit and scope of the invention. It is therefore, to be understood that the spirit and scope of the invention be limited only by the appended claims.

INDUSTRIAL APPLICABILITY

The above described variable geometry catalytic converter for optimizing hydrocarbon conversion at low exhaust gas temperatures and avoiding excessive sulfate formation at high exhaust gas temperatures may be provided in the exhaust gas stream of any internal combustion device. Examples of such may be boilers, furnaces, internal combustion engines and particularly diesel engines, where it is favorable to remove hydrocarbon formations found in the exhaust gases as well as the avoidance of sulfate or other compounds such a $NO_2$ formation prior to the emission of the exhaust gas to the atmosphere. The size and composition of the catalyst beds provided within the catalytic converter are chosen to provide the best hydrocarbon conversion/sulfate formation trade-off for the particular environment.

I claim:

1. An exhaust gas purification system comprising:

a first exhaust gas flow passage;

a first exhaust gas treatment means positioned within said first exhaust gas flow passage for removing hydrocarbons from said exhaust gas and retarding the formation of sulfate under low exhaust gas temperature conditions;

a second exhaust gas flow passage fluidically separate from said first exhaust gas flow passage;

a second exhaust gas treatment means positioned within said second exhaust gas flow passage for removing hydrocarbons and retarding the formation of sulfate under high exhaust gas temperature conditions;

an exhaust gas flow directing means for directing the flow of the exhaust gas exclusively through said first flow passage in a first mode of operation and for directing the flow of exhaust gas exclusively through said second flow passage in a second mode of operation; and a control means for controlling the mode of operation of said flow directing means n response to exhaust gas temperature;

wherein said exhaust gas flow directing means is caused to operate in said first mode under low exhaust gas temperature conditions and in said second mode under high exhaust gas temperture conditions.

2. The system as defined in claim 1, wherein said first and second treatment means are catalytic converters.

3. The system as defined in claim 2, wherein said first catalytic converter is greater in volume than said second catalytic converter and includes lower space velocities than said second catalytic converter.

4. The system as defined in claim 2, wherein said first catalytic converter is of a different composition than said second catalytic converter.

5. The system as defined in claim 4, wherein said first catalytic converter is a precious metal catalytic converter.

6. The system as defined in claim 4, wherein said second catalytic converter is any one from a group including base metal catalytic converters and precious metal catalytic converters.

7. The system as defined in claim 1, wherein said flow directing means is a high temperature value.

8. The system as defined in claim 1, wherein said first and second exhaust gas flow passages, said first and second exhaust gas treatment means and said flow directing means are housed within a housing having an inlet and an outlet.

9. The system as defined in claim 8, further comprising a sound attenuation means positioned within said housing at said outlet, wherein the exhaust gas flowing through each of said first and second exhaust gas flow passages passes through said sound attenuation means and out said outlet.

10. The system as defined in claim 9, wherein said sound attenuation means is a muffler.

11. A system for reducing detectable hydrocarbons in the exhaust of a diesel engine and for retarding the formation of sulfate comprising;

a housing having an inlet and an outlet;

a first exhaust gas flow passage extending from said inlet to said outlet within said housing;

a first exhaust gas treatment means positioned within said first flow passage for reducing the hydrocarbon in the exhaust gas and for retarding the formation of sulfate under low exhaust gas temperature conditions;

a second exhaust gas flow passage fluidically separate from said first exhaust gas flow passage and extending from said inlet to said outlet within said housing;

a second exhaust gas treatment means positioned within said second flow passage for reducing the hydrocarbon in the exhaust gas and for retarding the formation of sulfate under high exhaust gas temperture conditions;

an exhaust gas flow directing means for directing the flow of the exhaust gas exclusively through said first passage in a first mode of operation and for directing the flow of exhaust gas exclusively through said second flow passage in a second mode of operation; and a control means for controlling the mode of operation of said flow directing means in response to exhaust gas temperature;

wherein said exhaust gas flow directing means is caused to operate in said first mode under low exhaust gas temperature conditions and in said second mode high exhaust gas temperature conditions.

12. The system as defined in claim 11, wherein said first and second treatment means are catalytic converters.

13. The system as defined in claim 12, wherein said first catalytic converter is greater in volume than said second catalytic converter and includes lower space velocities than said second catalytic converter.

14. The system as defined in claim 12, wherein said first catalytic converter is of a different composition than said second catalytic converter.

15. The system as defined in claim 14, wherein said first catalytic converter is a precious metal catalytic converter.

16. The system as defined in claim 14, wherein said second catalytic converter is any one from a group including base metal catalytic converters or precious metal catalytic converter.

17. The system as defined in claim 11, wherein said flow directing means is a high temperature valve.

18. The system as defined in claim 11, further comprising a sound attenuation means positioned within said housing at said outlet, wherein the exhaust gas flowing through each of said first and second exhaust gas flow passages passes through said sound attenuation means and out said outlet.

19. The system as defined in claim 18, wherein sound attenuation means is a muffler.

* * * * *